United States Patent [19]

Jensen

[11] Patent Number: 4,720,931

[45] Date of Patent: Jan. 26, 1988

[54] SHOTGUN LOADING

[76] Inventor: Hans S. Jensen, Borgergade 28, Magleby 4672 Klippinge, Denmark

[21] Appl. No.: 39,688

[22] Filed: Apr. 20, 1987

[30] Foreign Application Priority Data

Apr. 26, 1986 [GB] United Kingdom ..... 8610277

[51] Int. Cl.[4] ..... F42B 39/06; F41C 27/00

[52] U.S. Cl. ..... 42/87

[58] Field of Search ..... 42/87, 88, 90

[56] References Cited

U.S. PATENT DOCUMENTS 211,691 1/1879 Bennett ..... 42/87

4,509,284 4/1985 Naber ..... 42/87

*Primary Examiner*—Charles T. Jordan

*Attorney, Agent, or Firm*—Larson and Taylor

[57] ABSTRACT

A charger for loading cartridges into a shotgun tubular magazine comprises:

a housing that houses a column of cartridges;

a keeper for releasably keeping the housed cartridges in the housing;

a bias spring under an elevatable floor on which the housed cartridges can ride out;

and an ejector 31 for ejecting from the housing successive cartridges into the housing.

The ejecting cartridges thereby become oriented relative to the magazine. The charger can be adapted to be manually mounted or fixedly mounted to the shotgun.

10 Claims, 21 Drawing Figures

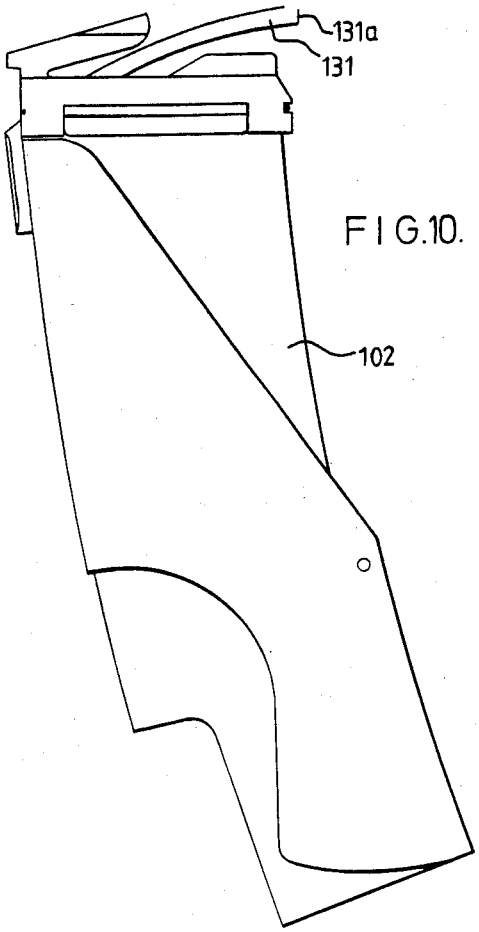
FIG.10.
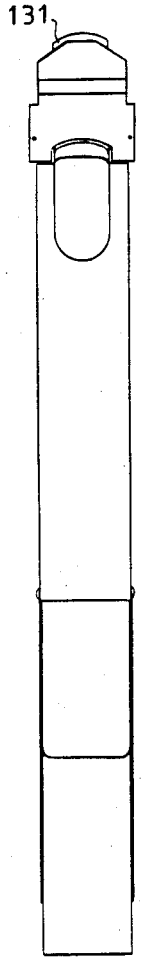
FIG.11.
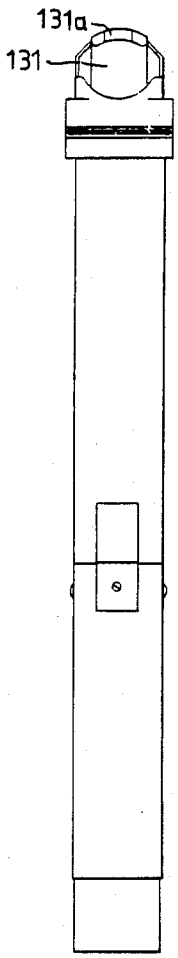
FIG.12.
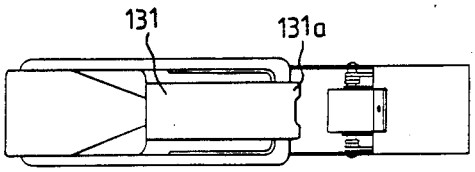
FIG.13.
FIG.14.
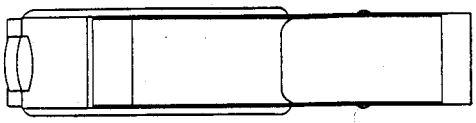

SHOTGUN LOADING

Shotguns are versatile guns. Some shotguns have magazines that are part of the guns. Such a gun can fire cartridges successively from the magazine. The cartridges in the magazine can be a row of cartridges arranged so that the forward end of a cartridge follows the rear end of a leading cartridge. One example of a magazine is a tubular magazine disposed below a breechloading shotgun's single barrel.

It has now been found in accordance with the present invention that loading of a shotgun tubular magazine can be expedited by using a charger that constrains cartridges to move in a magazine loading path defined by a plurality of components of motion.

A first aspect of the invention provides a charger for loading cartridges into a shotgun tubular magazine having catch means for preventing backwards motion of cartridge(s) during said loading, the charger comprising:

(a) a housing for containing at least one column of cartridges, wherein in said column cartridges will be arranged side by side and one above the other, the housing comprising a mouth through which said housed cartridges can pass successively into and out of the housing;

(b) keeper means for releasably keeping said cartridges in the housing;

(c) bias means for biassing said housed cartridges into a first path of motion leading towards the housing mouth;

(d) ejector means for ejecting from the housing successive cartridges into the magazine via the housing mouth, the ejector means being adapted to move in a second path of motion, this path leading to the rear end of an ejecting cartridge, that cartridge thereby having been provided with components of motion corresponding to the first and second paths, and thereby becoming oriented relative to the magazine.

A second aspect of the invention provides a method of loading a shotgun tubular magazine, comprising carrying out that loading with at least one charger according to the first aspect of the invention.

A third aspect of the invention provides an adapter for constituting said housing mouth.

The charger, method, and adapter can be embodied in any suitable manner(s) and from any suitable material(s). The embodying can utilise various treatments of materials and various surface coatings, e.g. hardening treatments, coating treatments (for instance black colouring or polytetrafluoroethylene or other surface coatings).

The housing can house any suitable number of cartridges, e.g. 2 to 14 depending on the geometry of the housing. The cartridges can have any dimensions appropriate to the loading into the magazine, e.g. cartridges that are between 60 and 75 mm in length, and cartridges that are e.g. 10, 12, 16, or 20 bore (gauge). Some housings will house only single columns of cartridges. Said housing can be operatively disposed relative to a magazine so as to enable communication between the inlet port of the shotgun's receiver and the housing mouth. The housing can be manually or fixedly (e.g. pivotally) mounted to the shotgun. A pivot block (e.g. yoke) for pivotally mounting the housing to the shotgun can be portion(s) of the receiver and/or magazine, or can be attached to the receiver and/or magazine by any means, e.g. pins and/or screws. The housing can comprise first latch means, for releasably latching the housing mouth to the inlet port of the receiver. The first latch means can comprise at least one abutment for entering the inlet port and overlying inside the receiver an adjacent edge of the inlet port. The housing mouth can be detachably or fixedly mounted to the housing. The housing can comprise second latch means, for releasably latching the housing mouth to the housing. A housing mouth can be adapted for mounting to different type housings, e.g. for 5 or 14 cartridges. A housing can contain at least one guide way for enabling the first path to be substantially linear and/or have curvature. A linear guide way can hold up to 5 cartridges, or any other suitable number. A curved guide way can hold more than 10 cartridges, or any other suitable number, e.g. a guide way having what may be termed banana shape. A curved guide way can compensate for slight tapering that might occur with some kinds of the housed cartridges.

The keeper means will detain housed cartridge(s) until the ejector means has been suitably actuated. The keeper means can comprise at least one abutment extending from the housing mouth so as to cover at least a portion of the uppermost housed cartridge. The at least one abutment can comprise at least one flange and/or at least one sleeve, or the like. The at least one abutment can be a guide, stop, notional or real fulcrum against which an ejecting cartridge can become oriented, e.g. tilted.

The bias means can comprise spring means in the housing, e.g. spring means made from round spring steel wire or from spring steel strip metal (for instance flat metal spring steel). The bias means can be arranged under the at least one column of cartridges. The housing can contain floor means movable in the housing, upper surface of the floor means being for supporting the at least one column of cartridges, the bias means abutting lower or other surface of the floor means. The bias means and/or floor means can be adapted to prevent operative action of the ejector means after ejection of the last housed cartridge, e.g. provide an abutment for disabling that operative action.

The ejector means can comprise ejector abutment means (e.g. a probe) movable for pushing in the second path successive housed cartridges. The housing can comprise at least one axis of rotation; the second path can comprise an arcuate path relative to the at least one axis of rotation; and the ejector abutment means can be pivotally mounted relative to the at least one axis of rotation. The ejector abutment means can be shaped to avoid contact with the primer caps of cartridges. The charger can comprise hand operable actuation means interconnecting the ejector abutment means and said at least one axis of rotation. The hand operable actuation means can comprise a hand grippable portion thereof, e.g. disposed below said at least one axis of rotation such that when that portion is moved towards the housing the ejector abutment means will move in the second path. The maximum amount of ejecting action of said ejector means can be limited, e.g. by a suitable disposition of said bias means (e.g. when made of spring steel strip metal). The charger means can comprise third latch means, for releasably latching in a non-ejecting mode said ejector means after ejection of a housed cartridge. That latching can result in sufficiently closing the housing mouth so as to secure in the housing any housed cartridge. The third latch means can be pivotally mounted to the hand grippable portion so as releasably to engage the housing, e.g. a corresponding bottom portion of the housing.

The adapter will be predetermined for compatability with at least one shotgun model. An adapter fixedly mounted to a shotgun can be suitable for chargers having or intended for e.g. 5 or 14 cartridges. An adapter manually mounted to a shotgun can be suitable for chargers having or intended for e.g. 5 or 14 cartridges. The adapter can comprise mounting means for fixedly mounting the adapter to the shotgun. That mounting can enable the adapter and hence its housing to be pivoted into an operative mode from e.g. a carrying mode of the shotgun, so as to allow loading of housed cartridges into the magazine. The fixedly mounting of the adapter is preferably adapted to enable release of the adapter from that mounting, but the adapter can be integral with the receiver and/or the magazine. When the adapter is fixedly mounted to or a portion of the shotgun, the shotgun can be provided with at least one pivot point for enabling the pivoting of the adapter and hence the housing from a shotgun carrying mode to a shotgun loading mode. At least one pivot pin can be releasable from that at least one pivot point so as to enable release of the adapter from the shotgun. One example of providing said at least one pivot point is constituted by a yoke or other suitable mount for projecting from the shotgun. The shotgun can comprise latch means for latching the charger in a shotgun carrying or loading mode, e.g. manually actuated latch means or automatically actuated latch means when the adapter and hence the housing are to be pivoted into the shotgun loading mode.

In the accompanying drawings, which are by way of example of the present invention and refer to shotguns having tubular magazines:

FIG. 10 is a side face view of a second embodiment of a charger.

FIG. 11 is a left edge view of the charger of FIG. 10.

FIG. 12 is a right edge view of the charger of FIG. 10.

FIG. 13 is top view of the charger of FIG. 10.

FIG. 14 is a bottom view of the charger of FIG. 10.

Figure 15:
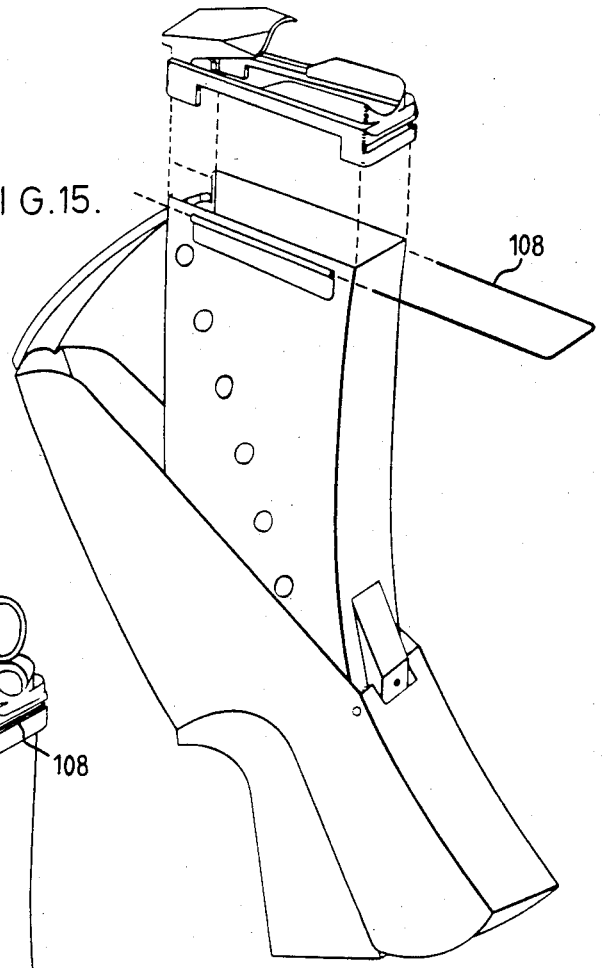
FIG. 15 is an exploded view corresponding to FIG. 10, showing the mounting of an adapter.
Figure 16:
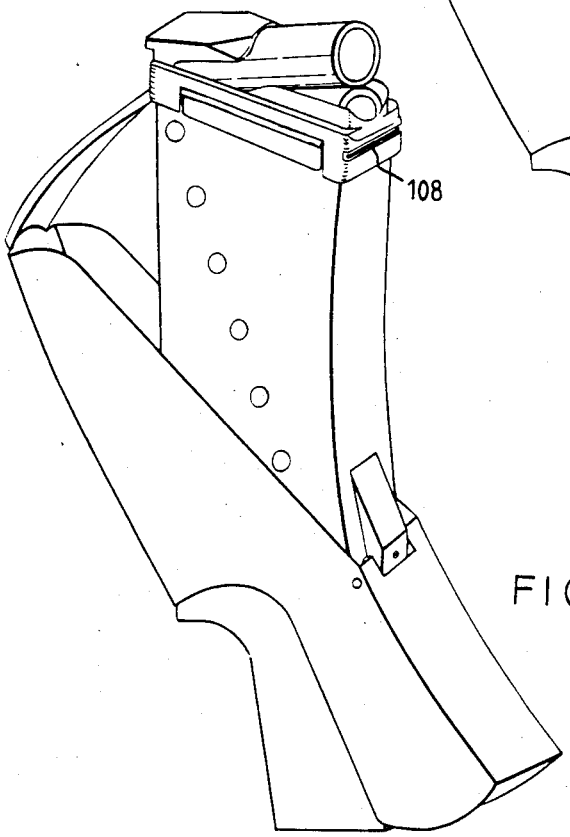
FIG. 16 is a perspective view showing the charger of FIG. 15 when in a loading mode.
Figure 17:
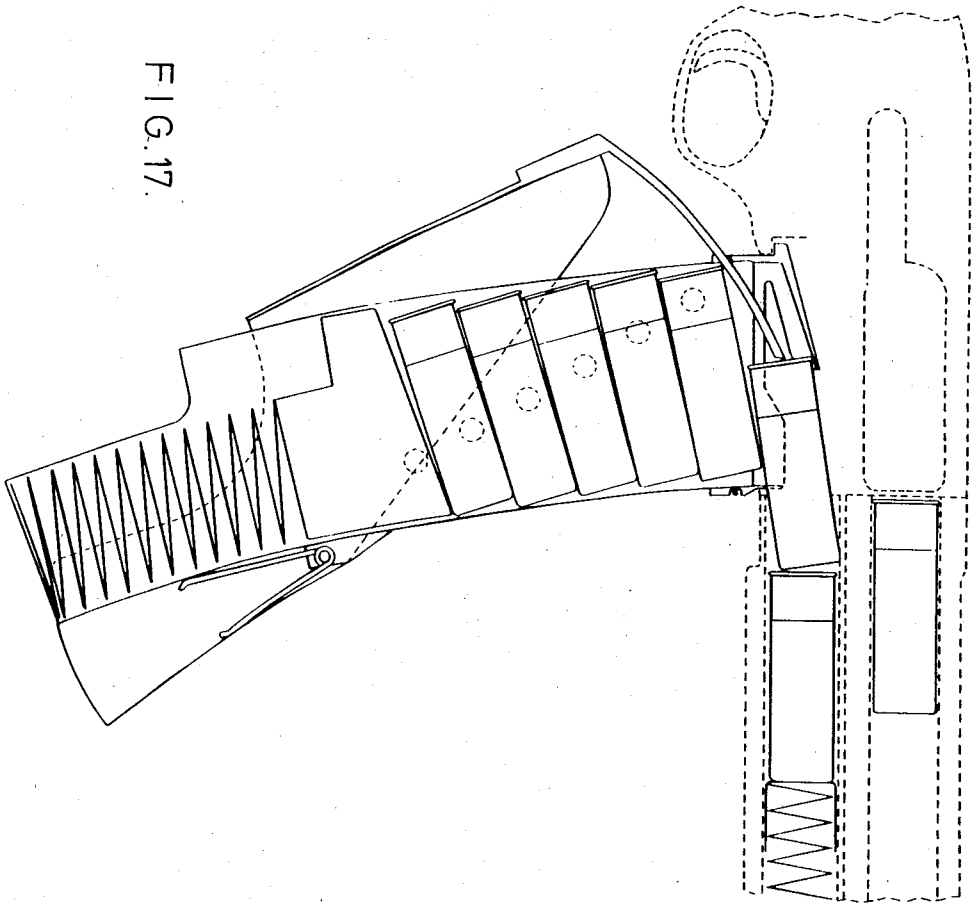
FIG. 17 is a sectioned side face view of the charger of FIG. 15, after the magazine has been partly loaded.
Figure 18:
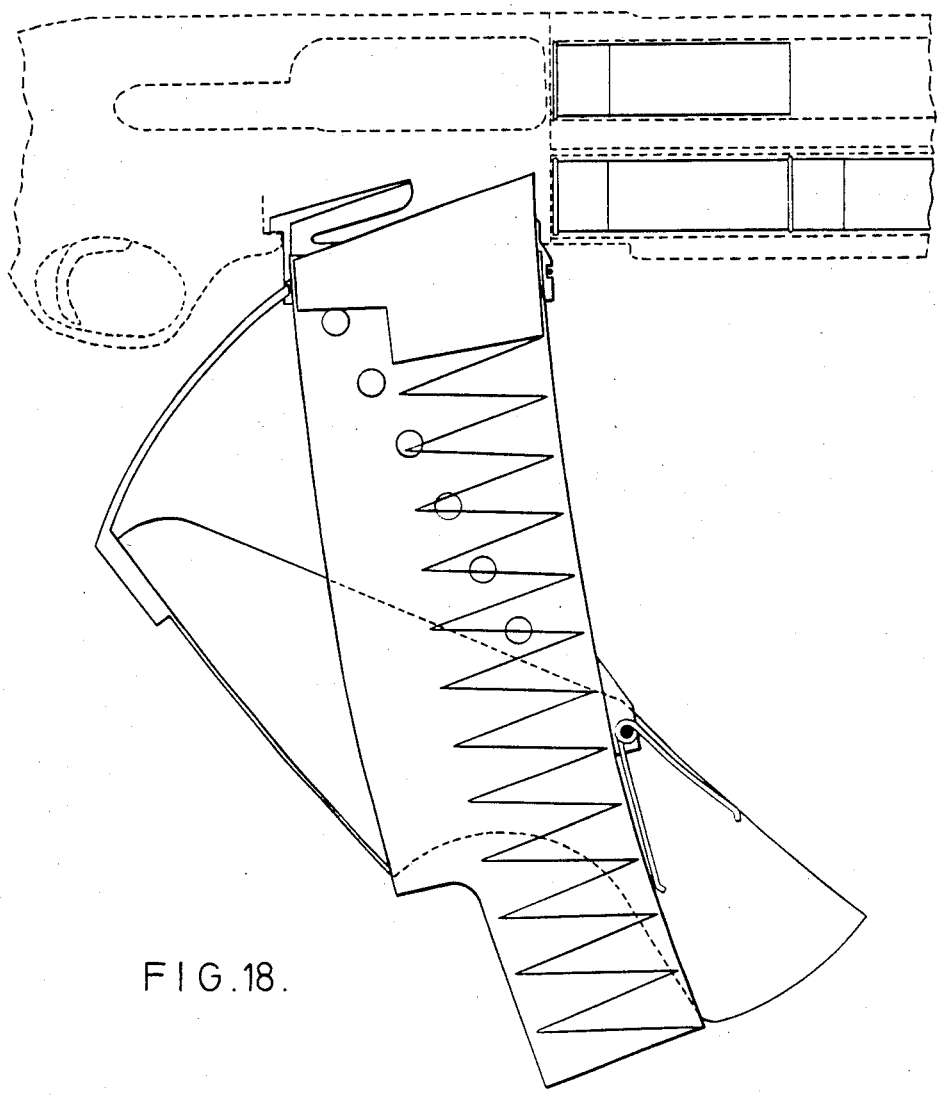

FIG. 18. is a sectioned side face view of the charger of FIG. 15, after the charger is emptied.

Figure 19:
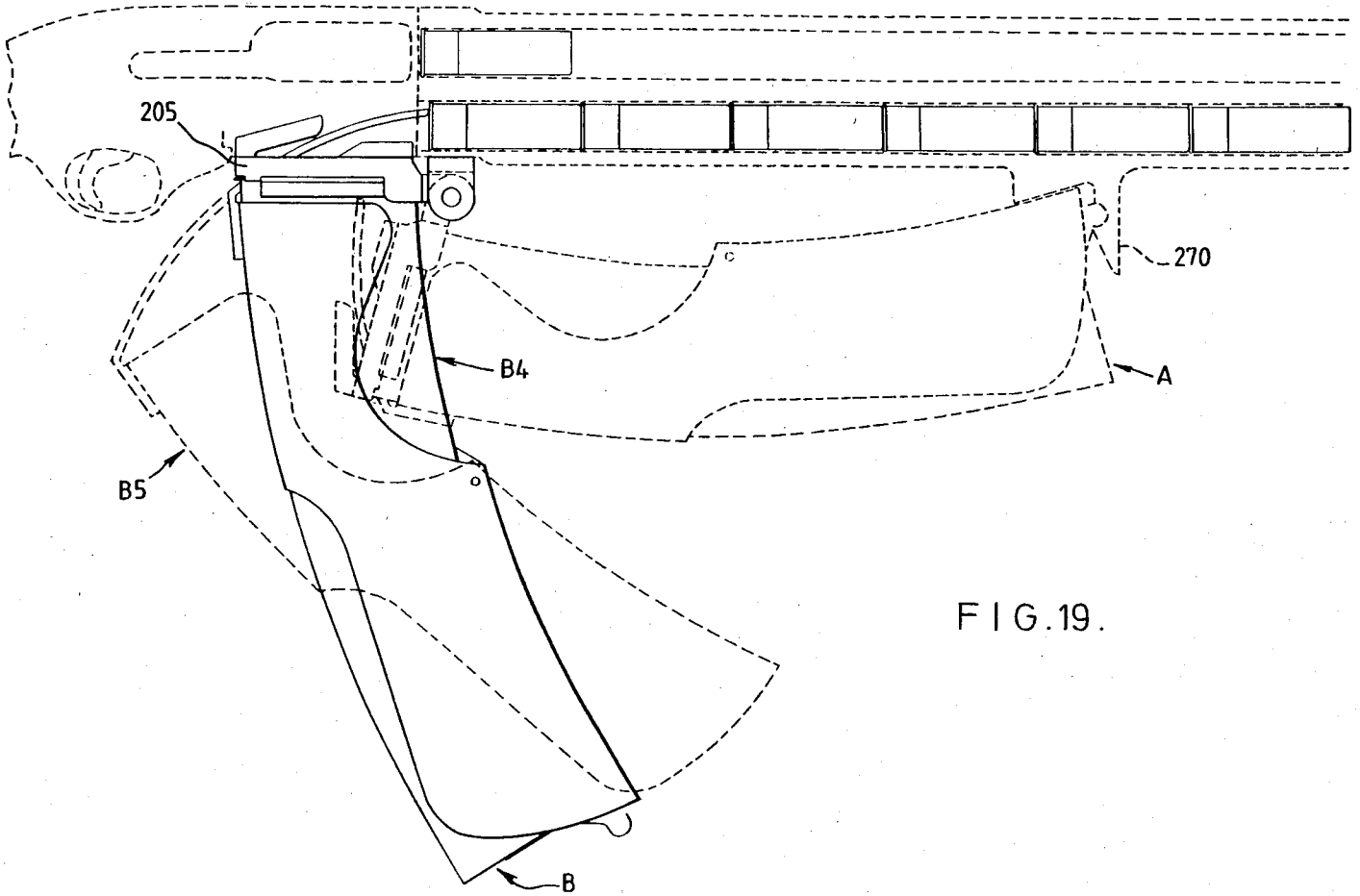

FIG. 19 is a side face view of a third embodiment of a charger.

Figure 20:
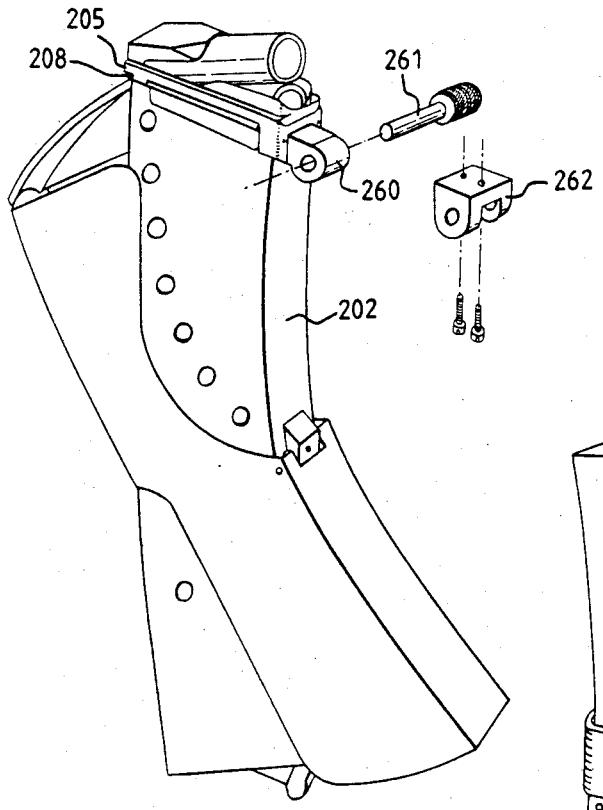

FIG. 20 is an exploded view of the charger of FIG. 19.

Figure 21:
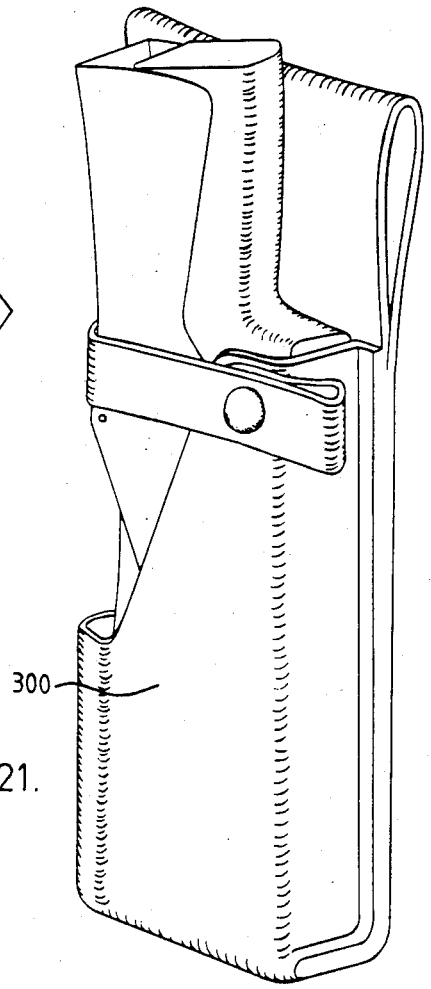

FIG. 21 shows an embodiment of a holster for a charger of FIGS. 10 to 18.

Referring to FIGS. 1 to 9, the charger 1 is for manually mounting to a shotgun. Charger 1 comprises a carrier or dispenser housing 2 that houses a column of cartridges A1–A7 one above the other and viewable through inspection apertures 3 in one or both of the opposite faces F1 and F2 of housing 2, which has an inlet/outlet mouth 4 defined by a detachable adapter 5 having lug 6 releasably latched to lug 7 fixed to housing 2, by a releasable pin 8 for that latching. Fixed to the left edge of the top of mouth 4 is a tilted arcuate channel abutment or guide 9 constituting keeper means for releasably keeping the tilted column of cartridges in housing 2. Guide 9 has a rearwardly directed lip 10 for entering the inlet port X in the shotgun's receiver W, to maintain engagement when forward pressure is applied in direction B4 (FIG. 9), and overlie inside port X the adjacent edge of port X. Fixed to the right edge of the top of mouth 4 are two upwardly directed abutments or guides 11, 12 for entering port X. Lip 10 and guides 11, 12 enable adapter 5 to be engaged and detachably mounted to port X. Receiver W can be constituted in any suitable manner for housing the breech block (not shown) of the shotgun. Ejected cartridges from charger 1 enter the magazine Y which can be constituted in any suitable manner. Magazine Y can be integral or not integral with receiver W, or have any other suitable relationship with receiver W.

In housing 2 is a bias spring 21 under a guide floor 22 having an upper tilted surface 23 on which the housed cartridges can ride upwardly each with a tilt corresponding to tilted surface 23. Floor 22 will obstruct forward motion of ejector probe 31 when the last cartridge has left housing 2, thereby preventing closure motion of hand operated actuation means 41, the obstructing indicating that the last cartridge has been ejected from housing 2.

Figure 1:
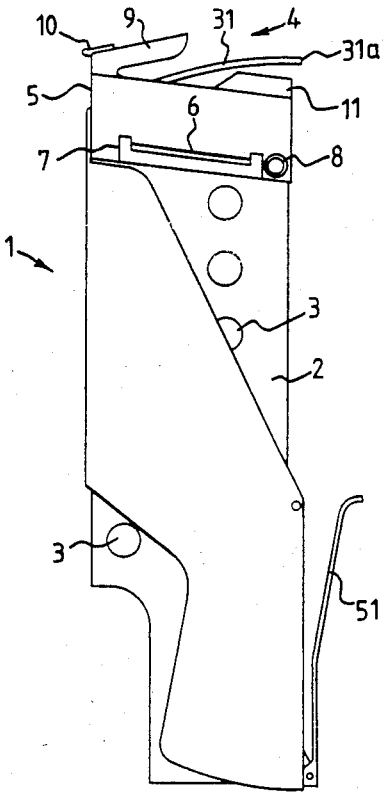
FIG. 1 is a side face view of a first embodiment of a charger.
Figure 2:
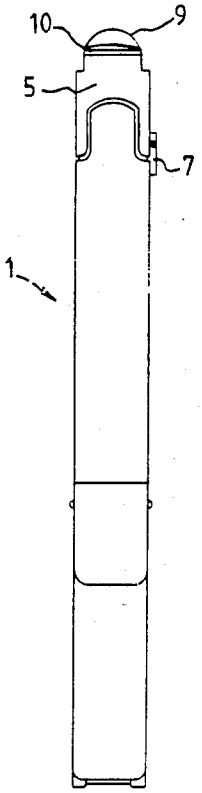
FIG. 2 is a left edge view of the charger of FIG. 1.
Figure 3:
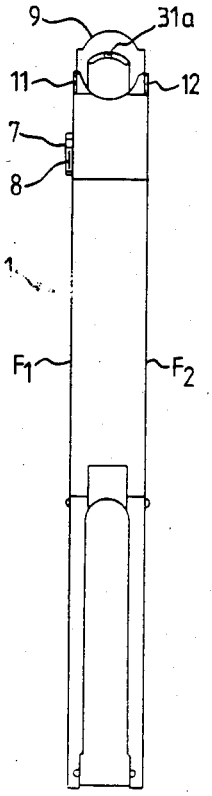
FIG. 3 is a right edge view of the charger of FIG. 1.
Figure 4:
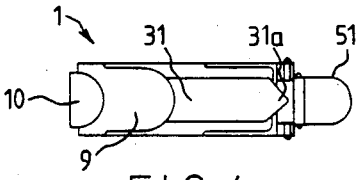
FIG. 4 is a top view of the charger of FIG. 1.
Figure 5:
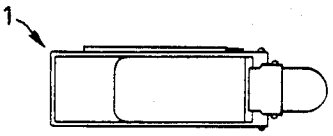
FIG. 5 is a bottom view of the charger of FIG. 1.
Figure 6:
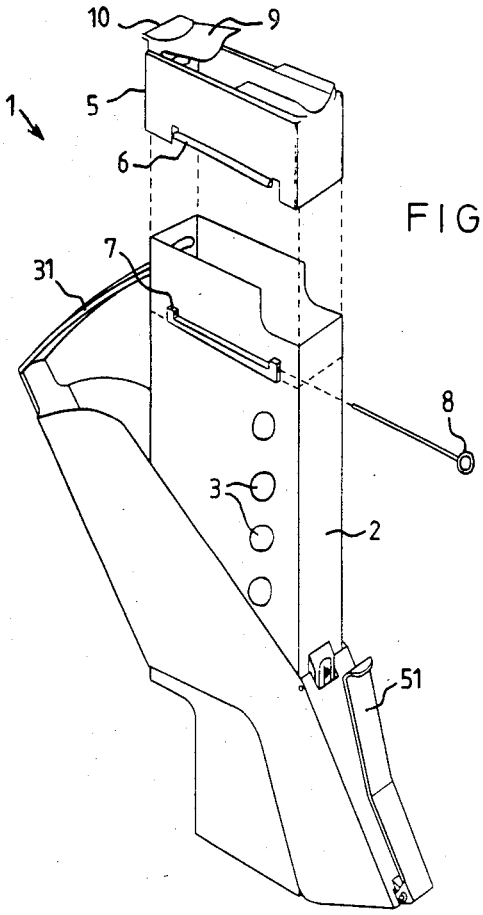
FIG. 6 is an exploded view corresponding to FIG. 1, showing the mounting of an adapter.
Figure 7:
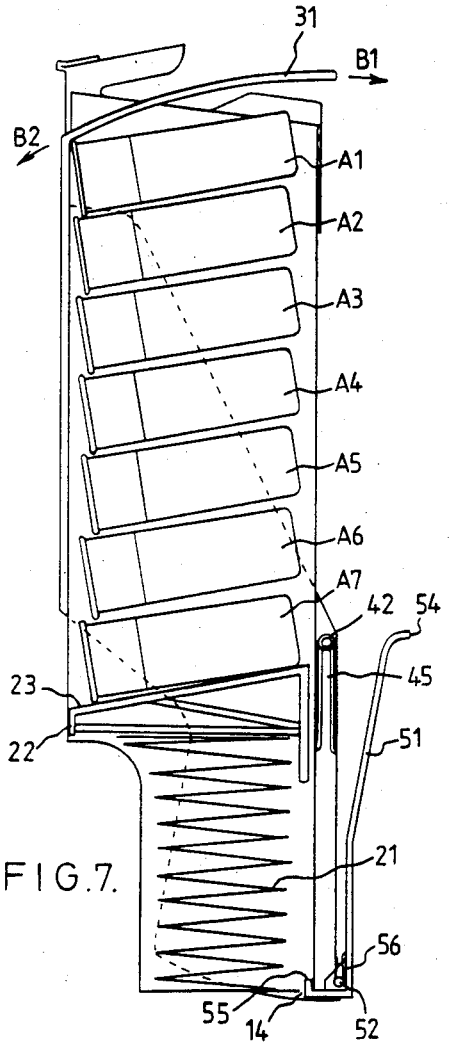
FIG. 7 is a sectioned side face view of the charger of FIG. 1 when in a carrying mode.
Figure 9:
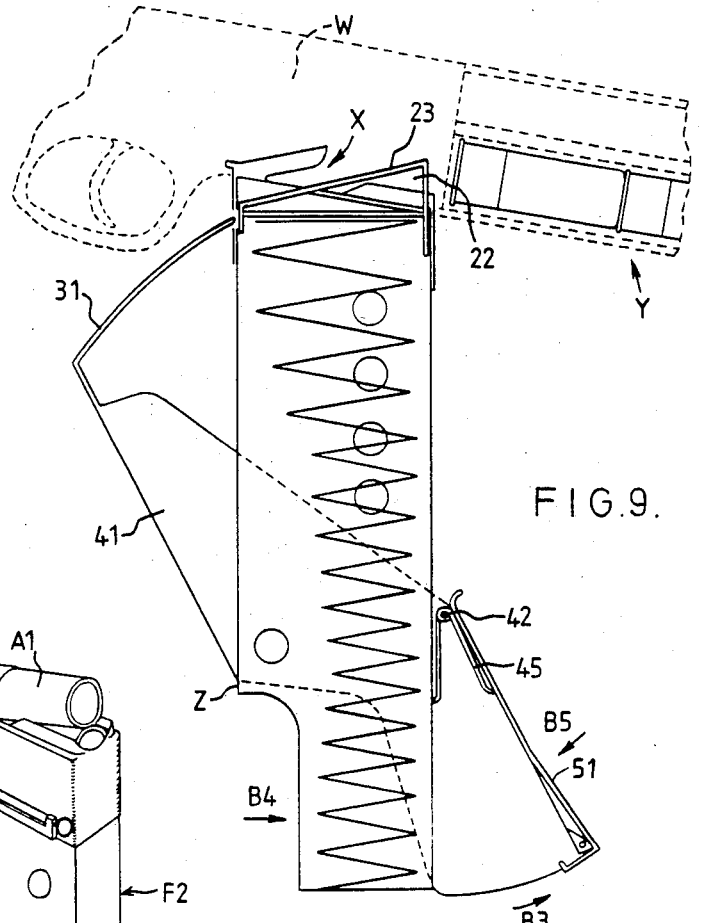
FIG. 9 shows the charger of FIG. 7 when mounted to the inlet port of a tubular magazine, after all cartridges have been loaded into the magazine.
Figure 8:
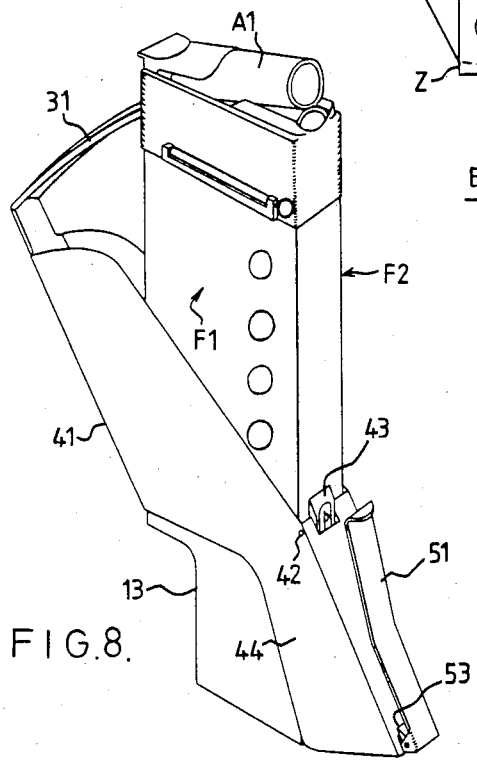
FIG. 8 is a perspective view showing the charger of FIG. 6 when in a loading mode.

Arcuate ejector probe 31 is pivotally mounted to move in an arcuate path B1, B2 (FIG. 7) so that the end 31*a* of probe 31 can push against the rear end of the cartridge available in mouth 4, thereby ejecting that cartridge into magazine Y until the cartridge is secured by the shotgun's catch (not shown). Probe 31 is an arm projecting from hand operated actuation means 41 of channel constitution embracing opposite faces F1, F2 of housing 2, and pivotally mounted to a pivot pin 42 fixed to a lug 43 fixed to the right edge portion of housing 2, whose lower left edge portion 13 is of reduced section to aid hand gripping with a hand grip 44 constituting the lower portion of hand operated actuation means for applying pressure in direction B5 (FIG. 9). A spring 45 is mounted on pivot pin 42, to bias hand grip 44 outwardly, in direction B3 (FIG. 9), and bias probe 31 towards the adjacent cartridge end in mouth 4. Point Z (FIG. 9) limits 41's outer motion.

Lever latch 51 is pivotally mounted to a pivot pin 52 fixed to a lug 53 fixed to the lower outer edge portion of grip 44. The upper end 54 of lever latch 51 is outwardly cranked to accommodate the upper edge of a hand when gripping the charger 1. The lower end 55 of lever latch 51 is inwardly cranked to provide a catch for entering a slot 14 in the adjacent bottom portion of housing 2. A spring 56 is mounted on pivot pin 52 so as to bias catch end 55 of latch 51 into slot 14 when hand grip 44 is sufficiently close to the adjacent edge of housing 2.

Housing 2 can be discharged of cartridges by hand operated motions of lever latch 51 and recharged manually by disabling probe 31 from obstructing mouth 4. Thus, cartridges can then be successively loaded into housing 2, the last cartridge in being the first cartridge out when magazine Y is being loaded.

Charger 1 can be carried in a carrier pocket or holster (not shown), which can be adapted to occupy space between upper end 54 of lever latch 51 and the adjacent edge of housing 2, thereby maintaining the closed mode of the charger. If lever latch 51 were not provided, charger 1 can be carried in a carrier pocket or holster 300 (FIG. 21) that would enclose the upper region of charger 1 and maintain the charger in a closed mode.

In the above example, and following examples, the tubular magazine Y has a known catch (not shown) for preventing backwards motion of cartridge(s) from magazine Y. The magazine Y is shown below a breechloading shotgun's single barrel. It will be appreciated that magazine can be otherwise disposed for another shotgun, e.g. mounted above or sideways relative to a barrel of such a gun.

FIGS. 10 to 18 are similar to FIGS. 1 to 9 but there are differences. For example, housing 102 (FIG. 10) is banana shaped whereas housing 2 (FIG. 1) is substantially linear. In FIGS. 10 to 18, a U-shaped pin 108 has replaced pin 8 of FIGS. 1 to 9. Pin 108 can be inserted from the front or rear. End 131*a* (FIG. 13) of probe 131 is recessed to ensure non-contact of end 131*a* with primer caps (not shown) of cartridges. However, the somewhat pointed end 31*a* (FIG. 4) of probe 31 is suitable appropriate cartridges.

FIGS. 19, 20 are similar to FIGS. 1 to 18 but there are differences. In FIGS. 19, 20, the housing 202 has a detachable adapter 205 mounted to housing 202 by a U-shaped locking pin 208 inserted from the rear. Adapter 205 has a pivot lug 260 to be pivotally engaged by a pivot pin 261 with a yoked lug 262 to be screw fastened to the shotgun (FIG. 19), whereby the shotgun will have carrying (A) and loading (B) modes. A spring catch 270 holds housing 202 in the shotgun carrying mode, securing that mode in a closed state. In FIG. 19, B4, B5 correspond to applied pressures B4, B5 in FIG. 9.

FIG. 21 shows an example of a holster 300 for the charger of FIGS. 10 to 18.

The chargers of FIGS. 1 to 20 can be modified according to the description given above before the first reference to the drawings. The present invention includes equivalents and modifications arising from all the disclosures herein of the present invention. It will be appreciated that the interiors of the housings can define any suitable said first or second path. A charger separate from a shotgun can be termed a cartridge carrier and/or dispenser. It will be appreciated that the charger can be mounted in any suitable manner to the shotgun, e.g. pivotally mounted to the shotgun's receiver and/or magazine when integral or not integral with the receiver.

I claim:

1. A charger for loading cartridges into a shotgun tubular magazine having catch means for preventing backwards motion of cartridge(s) during said loading, the charger comprising:

(a) a housing for containing at least one column of cartridges, wherein said column cartridges will be arranged side by side and one above the other, the housing comprising a mouth through which said housed cartridges can pass successively into and out of the housing;

(b) keeper means for releasably keeping said cartridges in the housing;

(c) bias means for biassing said housed cartridges into a first path of motion leading toward the housing mouth;

(d) ejector means for ejecting from the housing successive cartridges into the magazine via the housing mouth, the ejector means being adapted to move in a second path of motion, this path leading to the rear end of an ejecting cartridge, that cartridge thereby having been provided with components of motion corresponding to the first and second paths, and thereby becoming oriented relative to the magazine.

2. A charger as claimed in claim 1, wherein the housing is adapted to be manually mounted to the shotgun.

3. A charger as claimed in claim 1, wherein the housing is adapted to be fixedly mounted to the shotgun.

4. A charger as claimed in claim 3, wherein the housing is adapted to be pivotally mounted to the shotgun.

5. A charger as claimed in claim 1, comprising first latch means, for releasably latching the mouth to the inlet port of the shotgun's receiver.

6. A charger as claimed in claim 1, wherein the mouth is detachably mounted to the housing.

7. A charger as claimed in claim 1, wherein the housing contains at least one guide way for enabling the first path to be substantially linear.

8. A charger as claimed in claim 1, wherein the housing contains at least one guide way for enabling the first path to have curvature.

9. A charger as claimed in claim 1, wherein the ejector means comprises a probe.

10. A charger as claimed in claim 1, wherein the housing comprises at least one axis of rotation; the second path comprises an arcuate path relative to the at least one axis of rotation; and the ejector means is pivotally mounted relative to the at least one axis of rotation.

* * * * *